US005627129A

United States Patent [19]

Kung et al.

[11] Patent Number: 5,627,129

[45] Date of Patent: May 6, 1997

[54] STABILIZERS FOR RECEIVER USED IN THERMAL DYE TRANSFER

[75] Inventors: Teh-Ming Kung, Rochester; Daniel J. Harrison, Pittsford; Steven Evans, Rochester, all of N.Y.

[73] Assignee: Eastman Kodak Company, Rochester, N.Y.

[21] Appl. No.: 624,331

[22] Filed: Mar. 29, 1996

Related U.S. Application Data

[60] Provisional application No. 60/002974 Aug. 30, 1995.

[51] Int. Cl.[6] ..... B41M 5/035; B41M 5/38

[52] U.S. Cl. ..... 503/227; 428/195; 428/341; 428/412; 428/513; 428/913; 428/914

[58] Field of Search ..... 8/471; 428/195, 428/341, 412, 513, 913, 914; 503/227

[56] References Cited

U.S. PATENT DOCUMENTS 4,705,521 11/1987 Byers ..... 8/471
4,734,397 3/1988 Harrison et al. ..... 503/227
4,748,150 5/1988 Vanier et al. ..... 503/227
4,965,241 10/1990 Henzel et al. ..... 503/227

*Primary Examiner*—B. Hamilton Hess
*Attorney, Agent, or Firm*—Harold E. Cole

[57] ABSTRACT

A dye-receiving element for thermal dye transfer comprising a a support having on one side thereof, in order, a subbing layer of an amino-functionalized polymer, and a polymeric dye image-receiving layer, the receiving layer containing a stabilizer having the following structure:

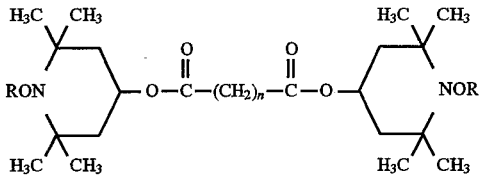

wherein n is an integer of about 4 to about 12, and

R is a substituted or unsubstituted alkyl group of at least 6 carbon atoms.

18 Claims, No Drawings

STABILIZERS FOR RECEIVER USED IN THERMAL DYE TRANSFER

CROSS REFERENCE TO RELATED APPLICATION

Reference is made to and priority claimed from U.S. Provisional application Ser. No. U.S. Ser. No. 60/002,974, filed 30 Aug. 1995, entitled STABILIZERS FOR RECEIVER USED IN THERMAL DYE TRANSFER.

This invention relates to dye-receiving elements used in thermal dye transfer, and more particularly to the use of a particular stabilizer for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements for thermal dye transfer generally comprise a polymeric dye image-receiving layer coated on a support. A compression, or cushion intermediate layer, for example as taught in U.S. Pat. No. 4,734,397 may also be present between the support and the dye image-receiving layer. Such cushion layers promote better contact between a dye-donor element and the dye-receiving element, which minimizes the formation of image defects during dye transfer and improves the scratch resistance of the dye-receiving element. In addition, subbing layers, for example as taught by U.S. Pat. No. 4,748,150, may also be present between the various layers to promote adhesion.

U.S. Pat. No. 4,965,241 relates to the use of amino-functionalized silane coupling agents as subbing layers in thermal dye transfer receivers. However, there is a problem with these subbing layers in that both the dark-keep thermal stability and the fingerprint resistance of the dyes in the receiver element are negatively affected.

U.S. Pat. No. 4,705,521 relates to improving the light stability of transferred dyes in a receiver element by providing a stabilizer in the dye-receiving layer and reheating the receiver after thermal dye transfer. However, there is a problem with this process in that it involves a reheating step, which is an extra step in the thermal dye transfer process.

It is an object of this invention to provide a dye-receiving element wherein the dye-receiving layer will significantly enhance the dark-keep thermal stability of imaged dyes in the dye-receiving layer when an amino-functionalized polymeric material is used as a subbing layer between the support and the dye-receiving layer. It is another object of this invention to provide a dye-receiving element wherein the fingerprint resistance of imaged dyes in the dye-receiving layer is improved, when an amino-functionalized polymeric material is used as a subbing layer between the support and the dye-receiving layer.

These and other objects are achieved in accordance with this invention which comprises a dye-receiving element for thermal dye-transfer comprising a a support having on one side thereof, in order, a subbing layer of an amino-functionalized polymer, and a polymeric dye image-receiving layer, the receiving layer containing a stabilizer having the following structure:

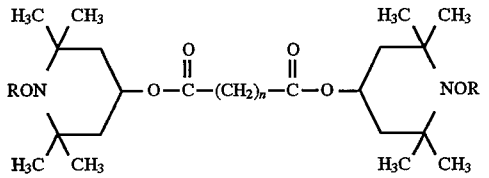

wherein n is an integer of about 4 to about 12, and

R is a substituted or unsubstituted alkyl group of at least 6 carbon atoms, such as chlorooctyl, s-dodecyl, 3-hydroxyhexyl, cyclohexyl, hexyl, octyl, dodecyl, hexadecyl, methoxyoctyl, 10-acetoxydecyl, 12-methoxycarbonyldodecyl, etc.

A substituted alkyl group in the above formula includes an alkyl group substituted with one or more of the following groups: halogen, cyano, alkyl, aryl, hetaryl, nitro, carboxy, alkoxy, aryloxy, alkoxycarbonyl, aryloxycarbonyl, acyloxy, aryloxy, acylamino, arylsulfonamido, alkylsulfonamido, hydroxy, alkylcarbamoyl, dialkylcarbamoyl, arylcarbamoyl, diarylcarbamoyl, arylalkylcarbamoyl, alkylureido, arylureido, alkylthio, arylthio, etc.

In a preferred embodiment of the invention, R in the above formula is $C_8H_{17}$ and n is 8. In another preferred embodiment, R in the above formula is $C_{12}H_{25}$ and n is 8.

The stabilizer compounds of the invention may be employed at any concentration which is effective for the intended purpose. In general, good results have been obtained at a coverage of from about 0.05 to about 1 g/m$^2$.

Compounds included within the scope of this formula include the following:

COMPOUND 1

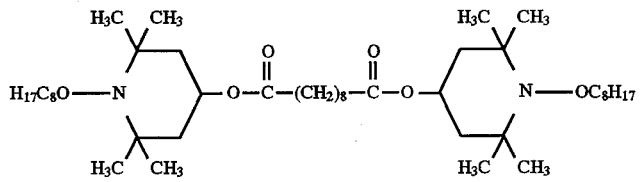

(available commercially as Tinuvin®-123 a liquid, MW 737, pKa 9–10)

COMPOUND 2

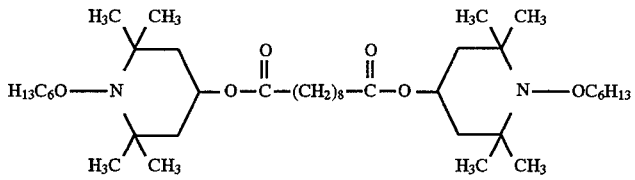

(a liquid, MW 681)

COMPOUND 3

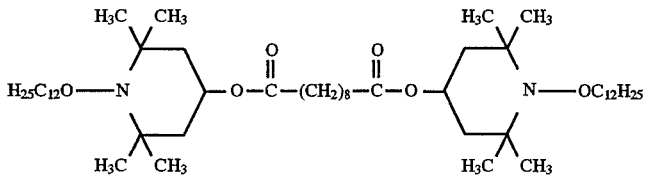

(a liquid, MW 849)

COMPOUNDS 4–8

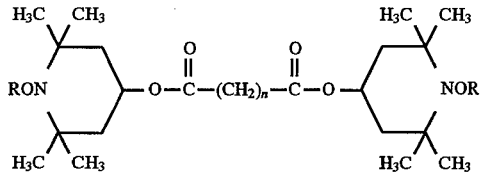

COMPOUND 4 n is 8 and R is $C_{10}H_{20}O_2CCH_3$

COMPOUND 5 n is 12 and R is c-$C_6H_{11}$

COMPOUND 6 n is 6 and R is $C_{12}H_{24}CO_2CH_3$

COMPOUND 7 n is 10 and R is $C_8H_{16}Cl$

COMPOUND 8 n is 4 and R is $CH_2CH(OCH_3)C_6H_{13}$

It has been found unexpectedly that incorporation of certain hindered-amine light stabilizers, i.e., hindered aminoethers of the above formula, in the dye-receiving layer will significantly enhance dark-keep thermal stability and will improve fingerprint resistance of imaged dyes in the dye-receiving layer when amino-functionalized polymeric materials are used as the subbing layer between the support and the dye-receiving layer. The stabilizer compounds of this type may be prepared by the techniques described in EPA 309402A-1 or J.Poly.Sci., Poly.Chem.Ed., 23, 1477 (1985).

An amino-functionalized polymeric subbing layer having a silicon oxide backbone employed in this invention is described in U.S. Pat. No. 4,965,241, the disclosure of which is hereby incorporated by reference.

The support for the dye-receiving element of the invention may be transparent or reflective, and may comprise a polymeric, a synthetic paper, or a cellulosic paper support, or laminates thereof. Examples of transparent supports include films of poly(ether sulfone)s, polyimides, cellulose esters such as cellulose acetate, poly(vinyl alcohol-co-acetal)s, and poly(ethylene terephthalate). The support may be employed at any desired thickness, usually from about 10 mm to 1000 mm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. The receiver element may also include a backing layer such as those disclosed in U.S. Pat. Nos. 5,011,814 and 5,096,875, the disclosures of which are incorporated by reference.

In a preferred embodiment of the invention, a paper substrate support bearing a polypropylene layer is used. In a further preferred embodiment, a microvoided composite film is employed such as OPPalyte 350TW®, (Mobil Chemical Co.) as disclosed in U.S. Pat. No. 5,244,861, the disclosure of which is hereby incorporated by reference. These polyolefin supports may be subject to a corona discharge treatment prior to being coated with the subbing layer.

The dye image-receiving layer of the dye-receiving elements of the invention may comprise, for example, a polycarbonate, a polyurethane, a polyester, poly(vinyl chloride), poly(styrene-co-acrylonitrile), polycaprolactone or mixtures thereof. In a preferred embodiment, polycarbonates are employed. The dye image-receiving layer may be present in any amount which is effective for the intended purpose. In general, good results have been obtained at from about 1 to about 10 g/m$^2$. An overcoat layer may be further coated over the dye-receiving layer such as those described in U.S. Pat. No. 4,775,657, the disclosure of which is incorporated by reference.

Conventional dye-donor elements may be used with the dye-receiving element of the invention. Such donor elements generally comprise a support having thereon a dye-containing layer. Any dye can be used in the dye-donor employed in the invention provided it is transferable to the dye-receiving layer by the action of heat. Especially good results have been obtained with diffusible dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon, mixtures of dyes or may have alternating areas of different dyes such as cyan, magenta, yellow, black, etc., as disclosed in U.S. Pat. No. 4,541,830.

A process of forming a dye transfer image according to the invention comprises:

a) imagewise-heating a dye-donor element comprising a support having thereon a dye layer comprising a dye dispersed in a binder, and b) transferring a dye image to a dye-receiving element as described above to form said dye transfer image.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner.

The following Example is provided to illustrate the invention.

EXAMPLE

The materials referred to in this example are the following:

| | |
|---|---|
| Prosil ® 221 | aminopropyl triethoxysilane (PCR, Inc.) |
| Z-6020 | N-2-aminoethyl)-3-aminopropyl triethoxysilane (Dow-Corning Co.) |
| Polymin P ® | polyethylenimine (BASF Corp.) |
| MEK | methyl ethyl ketone |
| Makrolon ® | a polyether-modified bisphenol A |
| KL3-1013 | polycarbonate block copolymer (Bayer Co.) |
| Lexan ® | bisphenol A polycarbonate (General |
| 141-112 | Electric Co.) |
| Fluorad ® | a perfluorinated alkylsulfonamido |
| FC-431 | alkylester surfactant (3M Corp.) |
| DBP | di-n-butyl phthalate |
| DPP | di-phenyl phthalate |

Control Stabilizer A

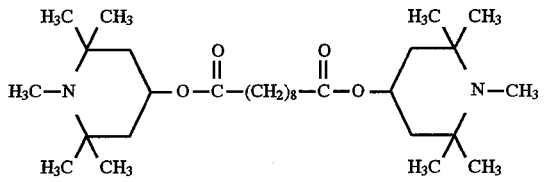

(available commercially as Tinuvin®-292) Liquid, MW 508, PKa 5–7

Control Stabilizer B

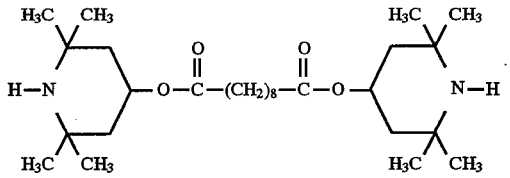

(available commercially as Tinuvin®-770) Power, MW 481, PKa 4–6

Control Stabilizer C

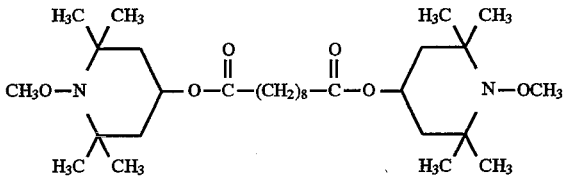

Liquid, MW 541

Control Stabilizer D

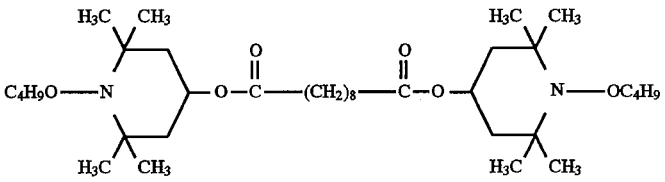

Liquid, MW 625

Subbing layer coating solutions were prepared separately by dissolving the individual amino-functional organosilanes, such as Prosil® 221 or Z-6020, in an ethanol-methanol-water solvent mixture.

Subbing layer coating solutions with amino-functional materials, such as Polymin P®, were prepared as 0.8% aqueous solutions.

The above test solutions were then coated onto a polypropylene-laminated paper support with a $TiO_2$-pigmented polypropylene skin (OPPalyte® 350 TWK packaging film from Mobil Chemical Co. laminated to paper support) (see U.S. Pat. No. 5,244,861) at a dry coverage of 0.11 g/m$^2$. Prior to coating, the support was subjected to a corona discharge treatment at approximately 450 joules/m$^2$.

Each of the above test samples was overcoated with a dye-receiving layer comprising Makrolon® KL3-1013 (1.82 g/m$^2$), GE Lexan® 141–112 (1.49 g/m$^2$), Fluorad® FC-431 (0.011 g/m$^2$), and a mixture of DBP, DPP and stabilizer when present (see Table), in a total coverage of 0.66 g/m$^2$ coated from methylene chloride. Stabilizer levels were adjusted to give equimolar amounts.

The dye-receiving layer was then overcoated at 0.22 g/m$^2$ with a solvent mixture of methylene chloride and trichloroethylene, a polycarbonate random terpolymer with blocks of bisphenol A (50 mole-%), diethylene glycol (49 mole-%), and polydimethylsiloxane (1 mole-%) (2500 MW).

Dye-donor elements were prepared and used for imaging the above test receivers as described in detail in U.S. Pat. No. 5,262,378, col. 6, line 42 through col. 8, line 29.

The imaged receiver samples were then subjected to a dark-keep thermal stability test at 60° C/70% RH for three days. The Status A green reflection densities, before and after keeping, of the magenta patch having an initial density of 1.7 were then compared, and the density loss was calculated and listed in the Table.

A fingerprint test was performed by applying the fingerprint of a thumb covered with Veriderm oil (Product 936Fu, no perfume, from Upjohn Co.) through a 1 cm$^2$ square cut out from polyethylene-coated paper stock, onto a 1.0 density (Status A) neutral patch (obtained by superimposed images from the cyan, magenta, and yellow donor patches printed onto imaged receiver samples as described above). These fingerprinted, neutral patches were then subjected to 60° C. and 70% RH storage for three days. The Status A red, green, and blue reflection densities before and after keeping were then compared, and the percent density loss was calculated. The Table shows sample identifications and test results.

TABLE

| SAMPLE | SUBBING LAYER | DBP (g/m2) | DPP (g/m2) | Stab. Cmpd. (g/m2) | Dark Stab. Loss ΔOD | Fingerprint Resist. ΔOD (green) |
|---|---|---|---|---|---|---|
| E-1 | Z-6020 | 0.3 | 0.3 | 1 (0.06) | 0.19 | — |
| E-2 | Z-6020 | 0.28 | 0.28 | 1 (0.11) | 0.19 | — |
| E-3 | Z-6020 | 0.25 | 0.25 | 1 (0.17) | 0.14 | — |
| E-4 | Z-6020 | 0.22 | 0.22 | 1 (0.22) | 0.07 | — |
| E-5 | Z-6020 | 0.23 | 0.23 | 2 (0.2) | 0.17 | — |
| E-6 | Z-6020 | 0.20 | 0.20 | 3 (0.25) | 0.0 | — |
| C-1 | Z-6020 | 0.33 | 0.33 | none | 0.23 | — |
| C-2 | Z-6020 | 0.24 | 0.24 | A (0.15) | 0.18 | — |
| C-3 | Z-6020 | 0.26 | 0.26 | B (0.14) | 0.32 | — |
| C-4 | Z-6020 | 0.25 | 0.25 | C (0.16) | 0.21 | — |
| C-5 | Z-6020 | 0.24 | 0.24 | D (0.19) | 0.23 | — |
| E-7 | Prosil ® 221 | 0.23 | 0.23 | 2 (0.20) | 0.05 | 0.12 |
| E-8 | Prosil ® 221 | 0.22 | 0.22 | 1 (0.22) | 0.04 | 0.11 |
| E-9 | Prosil ® 221 | 0.20 | 0.20 | 3 (0.25) | 0.04 | 0.10 |
| C-6 | Prosil ® 221 | 0.33 | 0.33 | none | 0.04 | 0.16 |
| C-7 | Prosil ® 221 | 0.24 | 0.24 | D (0.19) | 0.05 | 0.17 |
| E-10 | Polymin P ® | 0.22 | 0.22 | 1 (0.22) | 0.16 | — |
| E-11 | Polymin P ® | 0.20 | 0.20 | 3 (0.25) | 0.05 | — |
| E-12 | Polymin P ®* | 0.20 | 0.20 | 3 (0.25) | +0.04 | — |
| C-8 | Polymin P ® | 0.33 | 0.33 | none | 0.19 | — |
| C-9 | Polymin P ® | 0.24 | 0.24 | D (0.19) | 0.24 | — |

*Laydown was 0.022 g/m$^2$.

The above data show that use of the stabilizers of the invention in a thermal dye transfer receiver element containing a polymeric amino-functionalized subbing layer provides protection against dye losses during dark-keeping and resistance to fingerprint damage.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof, in order, a subbing layer of an amino-functionalized polymer, and a polymeric dye image-receiving layer, said dye image-receiving layer containing a stabilizer having the following structure:

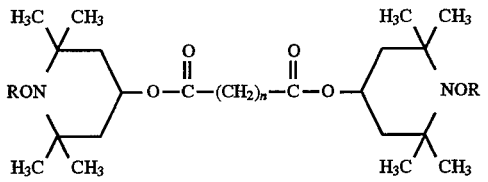

wherein n is an integer of about 4 to about 12, and

R is a substituted or unsubstituted alkyl group of at least 6 carbon atoms.

2. The element of claim 1 wherein R is $C_8H_{17}$ and n is 8.

3. The element of claim 1 wherein R is $C_{12}H_{25}$ and n is 8.

4. The element of claim 1 wherein said polymeric dye image-receiving layer comprises a polycarbonate.

5. The element of claim 1 wherein said support is a polyolefin-coated paper support.

6. The element of claim 1 wherein said stabilizer is present at a coverage of from about 0.05 to about 1 g/m$^2$.

7. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye-receiving element comprises a support having on one side thereof, in order, a subbing layer of an amino-functionalized polymer, and a polymeric dye image-receiving layer, said dye image-receiving layer containing a stabilizer having the following structure:

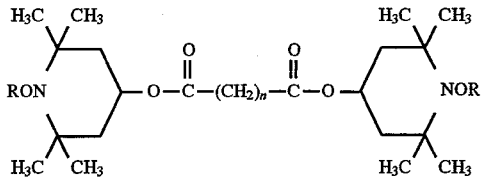

wherein n is an integer of about 4 to about 12, and

R is a substituted or unsubstituted alkyl group of at least 6 carbon atoms.

8. The process of claim 7 wherein R is $C_8H_{17}$ and n is 8.

9. The process of claim 7 wherein R is $C_{12}H_{25}$ and n is 8.

10. The process of claim 7 wherein said polymeric dye image-receiving layer comprises a polycarbonate.

11. The process of claim 7 wherein said support is a polyolefin-coated paper support.

12. The process of claim 7 wherein said stabilizer is present at a coverage of from about 0.05 to about 1 g/m$^2$.

13. A thermal dye transfer assemblage comprising:

a) a dye-donor element comprising a support having thereon a dye layer comprising a dye dispersed in a binder, and b) dye-receiving element comprising a support having on one side thereof, in order, a subbing layer of an amino-functionalized polymer, and a polymeric dye image-receiving layer, said dye image-receiving layer containing a stabilizer having the following structure:

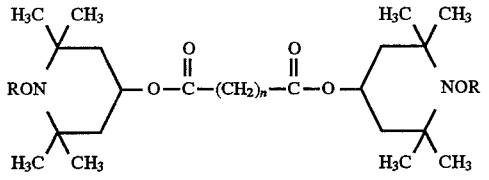

wherein n is an integer of about 4 to about 12, and

R is a substituted or unsubstituted alkyl group of at least 6 carbon atoms.

14. The assemblage of claim 13 wherein R is $C_8H_{17}$ and n is 8.

15. The assemblage of claim 13 wherein R is $C_{12}H_{25}$ and n is 8.

16. The assemblage of claim 13 wherein said polymeric dye image-receiving layer comprises a polycarbonate.

17. The assemblage of claim 13 wherein said support is a polyolefin-coated paper support.

18. The assemblage of claim 13 wherein said stabilizer is present at a coverage of from about 0.05 to about 1 g/m$^2$.

* * * * *